US010640349B2

(12) United States Patent
Prentice et al.

(10) Patent No.: US 10,640,349 B2
(45) Date of Patent: May 5, 2020

(54) TILTING SIDE-SHIFTING CARRIAGE FOR A LIFT TRUCK

(71) Applicant: Cascade Corporation, Fairview, OR (US)

(72) Inventors: Glenn Steven Prentice, Milwaukie, OR (US); Thomas Joshua McCall, Gresham, OR (US)

(73) Assignee: Cascade Corporation, Fairview, OR (US)

( * ) Notice: Subject to any disclaimer, the term of this patent is extended or adjusted under 35 U.S.C. 154(b) by 35 days.

(21) Appl. No.: 15/887,086

(22) Filed: Feb. 2, 2018

(65) Prior Publication Data

US 2019/0241417 A1 Aug. 8, 2019

(51) Int. Cl.

| | |
|---|---|
| ***B66F 9/16*** | (2006.01) |
| ***B66F 9/14*** | (2006.01) |
| ***B66F 9/22*** | (2006.01) |
| *B66F 9/07* | (2006.01) |

(52) U.S. Cl.

CPC ..... *B66F 9/16* (2013.01); *B66F 9/146* (2013.01); *B66F 9/22* (2013.01); *B66F 9/07* (2013.01)

(58) Field of Classification Search

CPC .. B66F 9/16; B66F 9/146; B66F 9/147; B66F 9/148

See application file for complete search history.

(56) References Cited

U.S. PATENT DOCUMENTS

| | | | | |
|---|---|---|---|---|
| 2,650,732 | A | 9/1953 | Hartquist | |
| 3,528,579 | A * | 9/1970 | Ulinski | B66F 9/122 414/640 |
| 3,734,327 | A * | 5/1973 | Ellis, Jr. | B66F 9/148 414/641 |
| 4,189,275 | A | 2/1980 | Arnold | |
| 4,755,100 | A | 7/1988 | Schultz et al. | |
| 5,174,708 | A | 12/1992 | Ruder et al. | |
| 5,217,343 | A | 6/1993 | Bostad et al. | |
| 5,368,435 | A | 11/1994 | Bostad et al. | |
| 6,279,686 | B1 * | 8/2001 | Kaup | B66F 9/143 187/227 |
| 6,851,915 | B2 | 2/2005 | Warner et al. | |
| 10,087,060 | B2 * | 10/2018 | Hamlik | B66F 9/146 |

(Continued)

FOREIGN PATENT DOCUMENTS

| | | |
|---|---|---|
| CN | 201825700 U | 5/2011 |
| CN | 102431935 A | 5/2012 |

(Continued)

OTHER PUBLICATIONS

United States Patent and Trademark Office; International Search Report and Written Opinion for Int'l App. No. PCT/US2019/012734; dated Apr. 15, 2019; 6 pages.

*Primary Examiner* — Mark C Hageman
(74) *Attorney, Agent, or Firm* — Chernoff, Vilhauer, McClung & Stenzel, LLP

(57) ABSTRACT

A carriage for a lift truck arranged to provide for both lateral shifting and tilting of attachments such as forklift forks, in which an outer frame of the carriage is supported by a side-shifter cylinder-and-piston assembly incorporated in an inner frame, and in which the outer frame can be tilted with respect to the inner frame, about a laterally-extending central axis of the side-shifter cylinder-and-piston assembly.

12 Claims, 10 Drawing Sheets

(56) References Cited

U.S. PATENT DOCUMENTS

| | | | | |
|---|---|---|---|---|
| 2004/0073359 | A1 | 4/2004 | Ichijo et al. | |
| 2008/0152471 | A1* | 6/2008 | Polvilampi | B66F 9/148<br>414/671 |
| 2017/0113907 | A1* | 4/2017 | Matti | B66F 9/16 |
| 2018/0354761 | A1* | 12/2018 | Addicott | B66F 9/12 |

FOREIGN PATENT DOCUMENTS

| | | | |
|---|---|---|---|
| CN | 104355273 | A | 2/2015 |
| CN | 205061492 | U | 3/2016 |
| CN | 103613054 | B | 4/2016 |
| CN | 105347260 | B | 12/2017 |
| EP | 2808289 | B1 | 3/2016 |

* cited by examiner

TILTING SIDE-SHIFTING CARRIAGE FOR A LIFT TRUCK

BACKGROUND OF THE INVENTION

The present application relates to lift trucks, and in particular to a carriage for lift truck attachments that includes a side-shifting mechanism and provides for the lift truck attachments to be tilted about an axis extending in the direction of side-shifting mechanism movement.

SUMMARY OF THE INVENTION

It is desirable for a lift truck attachment such as forklift forks to be able to tilt, thereby lowering or raising the tips of the forks. In some lift trucks tilting can be accomplished by tilting the mast on which a carriage for attachments is mounted. In other lift trucks, a mast is mounted on the truck at a fixed angle, usually so that the mast is vertical when the truck is on a level surface.

On such a lift truck, attachments such as forklift forks may be mounted on a carriage arranged to move vertically along the mast. The carriage typically includes an inner frame that is movable along the mast and an outer frame, carried by the inner frame, on which attachments such as forks may be mounted. The carriage may include a side-shifter mechanism for moving the attachments laterally with respect to the mast of the lift truck. Since the mast cannot be tilted with respect to the lift truck, the carriage must include a mechanism for tilting the attachments with respect to the mast.

A side-shifter mechanism typically includes at least one hydraulic cylinder-and-piston assembly arranged to move lift truck attachments laterally in either direction through a limited distance with respect to the mast on which the carriage is mounted.

In some previously known lift trucks including side-shifters incorporating hydraulic cylinders, an attachment-carrying outer frame portion of the carriage, able to be moved by the side-shifter, is supported on a laterally-extending upper support member that is part of the inner frame. The upper support member may be the top member of an inner frame portion of the carriage, extending between a pair of generally vertically extending side members of the inner frame. In some cases, the upper support member may be located immediately above the side-shifter cylinder-and-piston assembly. Such a laterally-extending upper support member has a cylindrical upper surface, and the outer frame portion of the carriage, moved by the side-shifter, includes bearings that can slide laterally along and pivot about the cylindrical surface of the laterally-extending upper support member as the forks or other attachments mounted on the outer frame are tilted.

The just-described arrangement requires regular cleaning and lubrication of the upper support member and bearings of the outer frame. It may also require special attachment of the side-shifter cylinder-and-piston assembly to the outer frame, to allow the outer frame to tilt with respect to the inner frame.

In other lift trucks with side-shifting and tilting capabilities the outer frame of the carriage may be mounted on a support shaft extending laterally between the side members of the inner frame. This sort of arrangement also requires bearings that allow rotational and translational movement of the outer frame relative to such a support shaft.

It is therefore desired to have a carriage for attachments for a lift truck with a vertical mast, in which both side-shifting and tilting of the carriage and attachments can be accomplished, and in which bearings accommodating side-shifting and tilting do not require routine maintenance.

The foregoing and other objectives, features, and advantages of the invention will be more readily understood upon consideration of the following detailed description of the invention taken in conjunction with the accompanying drawings.

BRIEF DESCRIPTION OF THE SEVERAL DRAWINGS

DETAILED DESCRIPTION OF PREFERRED EMBODIMENTS

Figure 1:
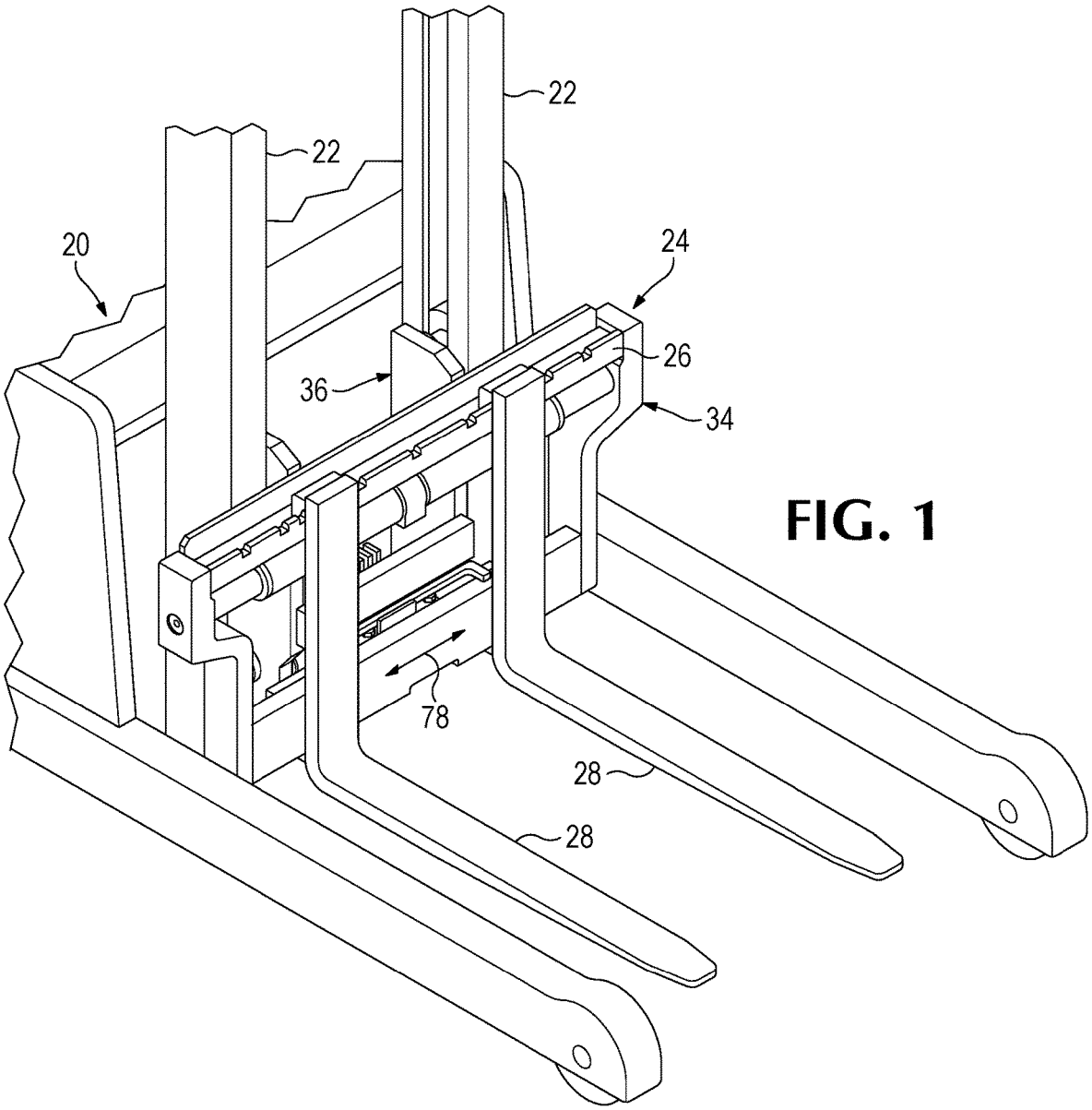
FIG. 1 is a perspective view of the front of a forklift truck on which a carriage including a tilting side-shifter embodying the present invention is mounted to support a pair of forklift forks.

Referring now to the drawings that form a part of the disclosure herein, a lift truck 20 shown in FIG. 1 has a vertically-extending mast 22. A carriage 24 is mounted on the mast 22 for movement upward or downward along the mast 22. The carriage 24 includes an upper attachment mounting bar 26, and a pair of forklift forks 28 are attached to the mounting bar 26 for movement along with the carriage 24 so as to engage and carry a load.

Figure 2:
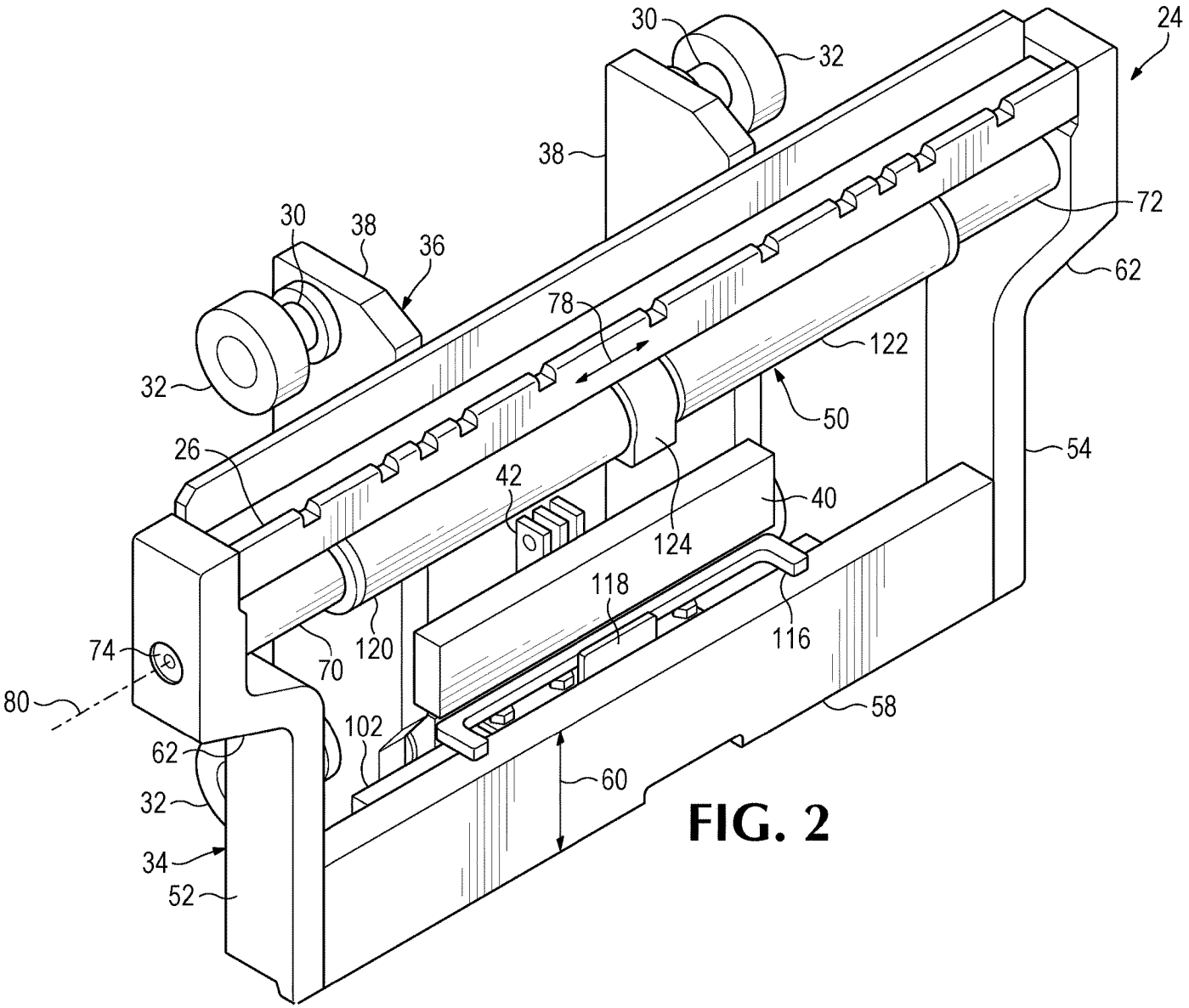
FIG. 2 is a front perspective view, at an enlarged scale, of the carriage shown in FIG. 1, separate from the forklift truck and forks.
Figure 3:
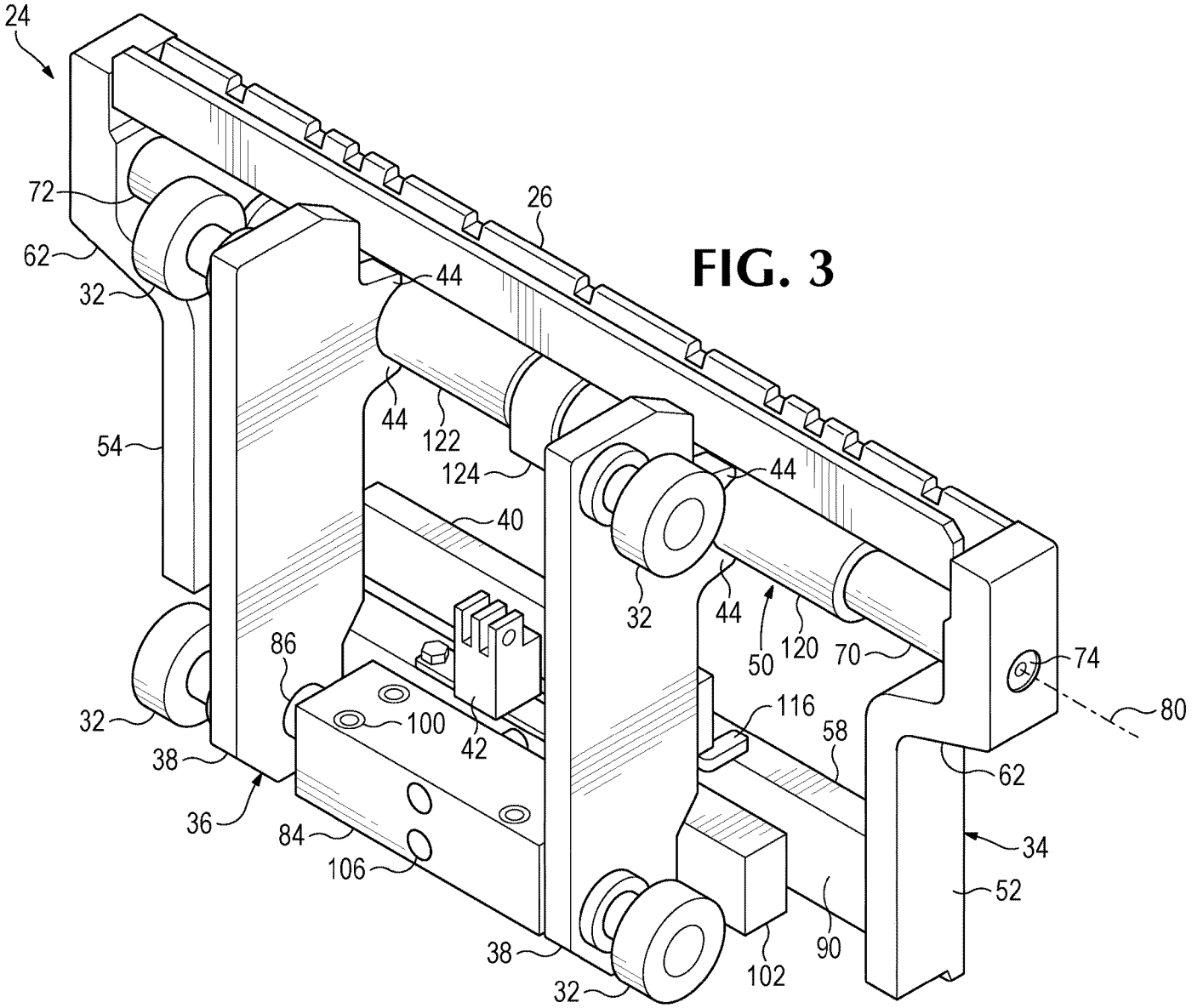
FIG. 3 is a perspective view from the rear of the carriage shown in FIG. 2.
Figure 4:
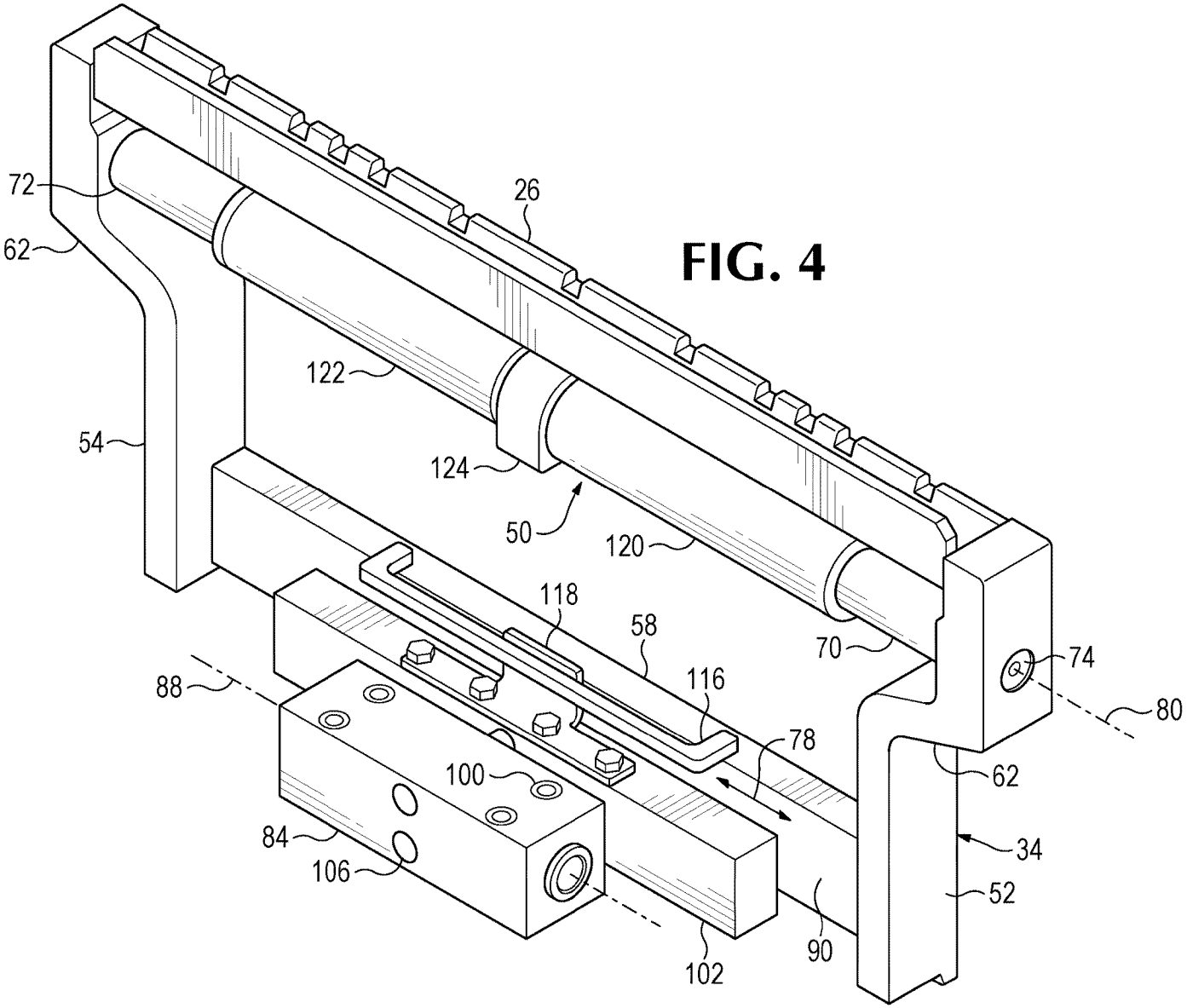
FIG. 4 is a perspective view taken in the same direction as FIG. 3, showing the front, or outer, frame portion of the carriage shown in FIGS. 1-3, together with a tilt cylinder block.
Figure 5:
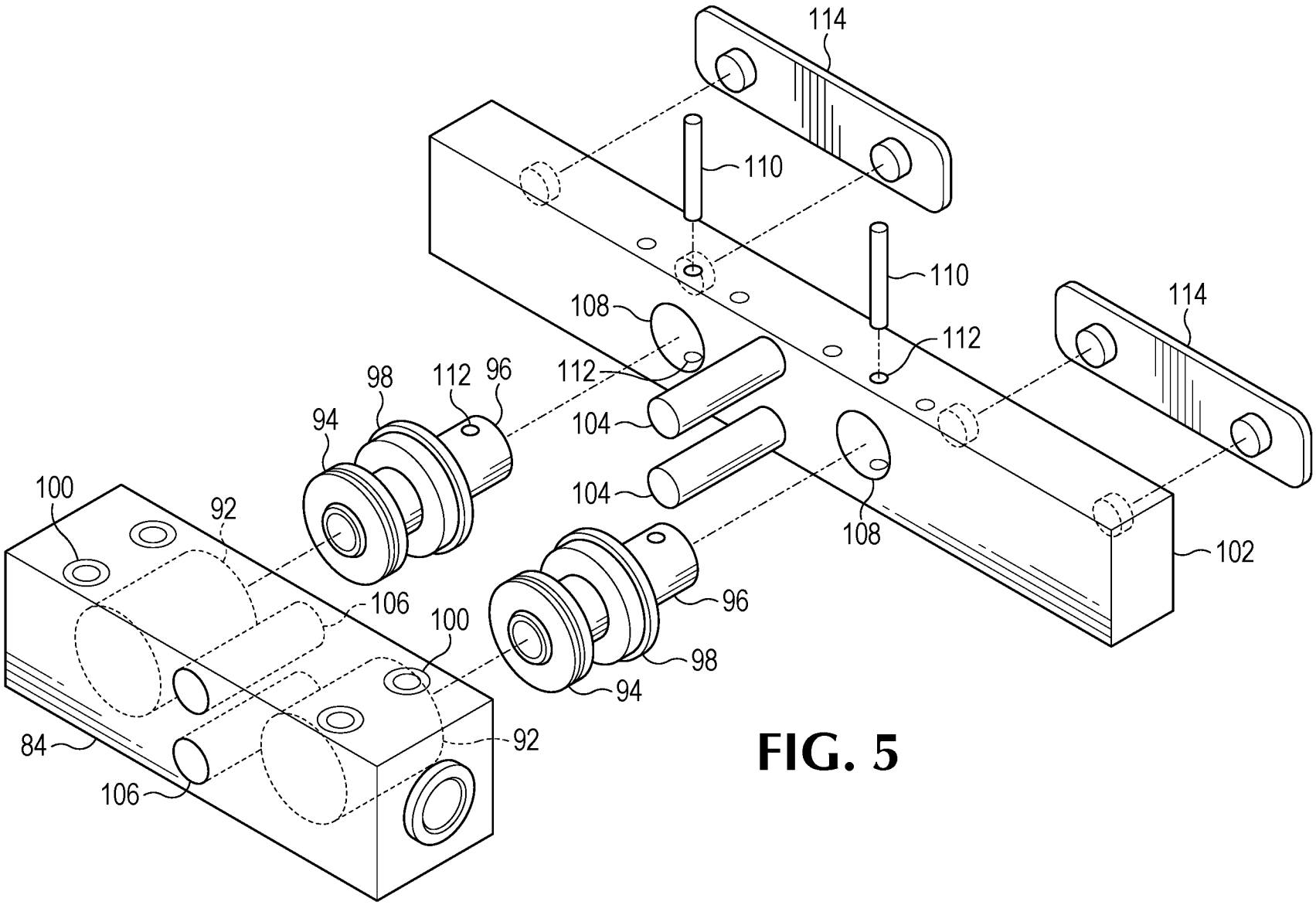
FIG. 5 is an exploded view taken in the same direction as FIGS. 3 and 4, showing the tilt cylinder block and an associated tilt-control pusher bar.

The carriage 24 is shown in FIGS. 2 and 3 without the forks 28, where it may be seen that there are a set of stub axles 30 on which respective wheels 32 are mounted. The wheels 32 are arranged to fit matingly within respective channels defined by the mast 22 and be movable along the channels as the carriage 24 is raised or lowered along the mast 22.

The carriage 24 includes a pair of frames, an outer frame 34 and an inner frame 36 that supports the outer frame as will be explained in greater detail presently. The stub axles 30 are mounted on respective ones of a pair of generally vertical side members 38 of the inner frame 36. The side members 38 are spaced apart from each other laterally of the carriage 24 by a distance limited by the space available between a pair of side members of a mast 22 with which the carriage 24 is associated, as will be understood from FIG. 1. A transverse structural member 40 extends between the side members 38 and is securely fastened to them, as by welding. A lift fixture 42 may be attached to the transverse member 40 to receive a cable or chain 46 by which the carriage 24 can be raised or lowered along the mast 22.

A pair of outwardly facing C-shaped mounting receptacles 44, aligned horizontally with each other, are defined near upper ends of the side members 38, facing outwardly, toward the outer frame 34. A side-shifter cylinder-and-piston assembly 50, described in greater detail below, is held in the receptacles 44 and extends laterally between the side members 38. The cylinder portions of the side-shifter cylinder-and-piston assembly 50 are securely fastened, as by the cylinder portions being welded to each of the side members 38, thus interconnecting the side members 38. The cylinder portions of the side-shifter cylinder-and-piston assembly 50 are thus integrated in the inner frame 36 as a second rigid transverse structural member of the inner frame 36.

The outer frame 34 includes a pair of upright side members 52 and 54 that are interconnected with each other by a horizontal, upper attachment mounting bar 26 that extends between and is securely fastened, as by being welded, to each of the side members 52 and 54 at the top of the outer frame 34. A transversely-extending bottom attachment mounting member 58 interconnects the lower ends of side members 52 and 54, to which it is also securely attached, as by being welded. The bottom attachment mounting member 58 has a depth 60 that helps to give the outer frame 34 sufficient rigidity. For example, the depth 60 may be about 125 mm.

The lower part of the outer frame 34 may be relatively narrow with a width small enough to fit between a pair of outriggers of the lift truck, as may be seen in FIG. 1. The upper part of the outer frame 34 is wider, as a result of each of the side members 52 and 54 including a dog-leg portion 62, so that the upper attachment mounting member 26 is longer than the bottom attachment mounting member 58.

Piston rods 70 and 72 extend laterally and coaxially from opposite ends of the side-shifter cylinder-and-piston assembly 50. An outer end 74 of the piston rod 70 is securely fastened to the upper portion of the side member 52, as by being screwed tightly into a threaded bore defined in the side member 52, with a shoulder 75 of the piston rod 70 abutting the side member 52 solidly to establish a rigid relationship. An outer end 76 of the piston rod 72 is similarly fastened to the upper portion of the opposite side member 54 of the outer frame 34.

The piston rods 70 and 72 are fitted movably within respective cylinders 120 and 122 of the side-shifter cylinder-and-piston assembly 50 and attach the outer frame 34 to the inner frame 36 yet allow the outer frame 34 to be shifted sideward or tilted with respect to the inner frame 36. Thus, the inner frame 36 supports the outer frame 34, and loads carried by the carriage 24 are transmitted from the outer frame 34 to the inner frame 36 through the piston rods 70 and 72 and the cylinders 120 and 122 of the side-shifter cylinder-and-piston assembly 50.

Figure 6:
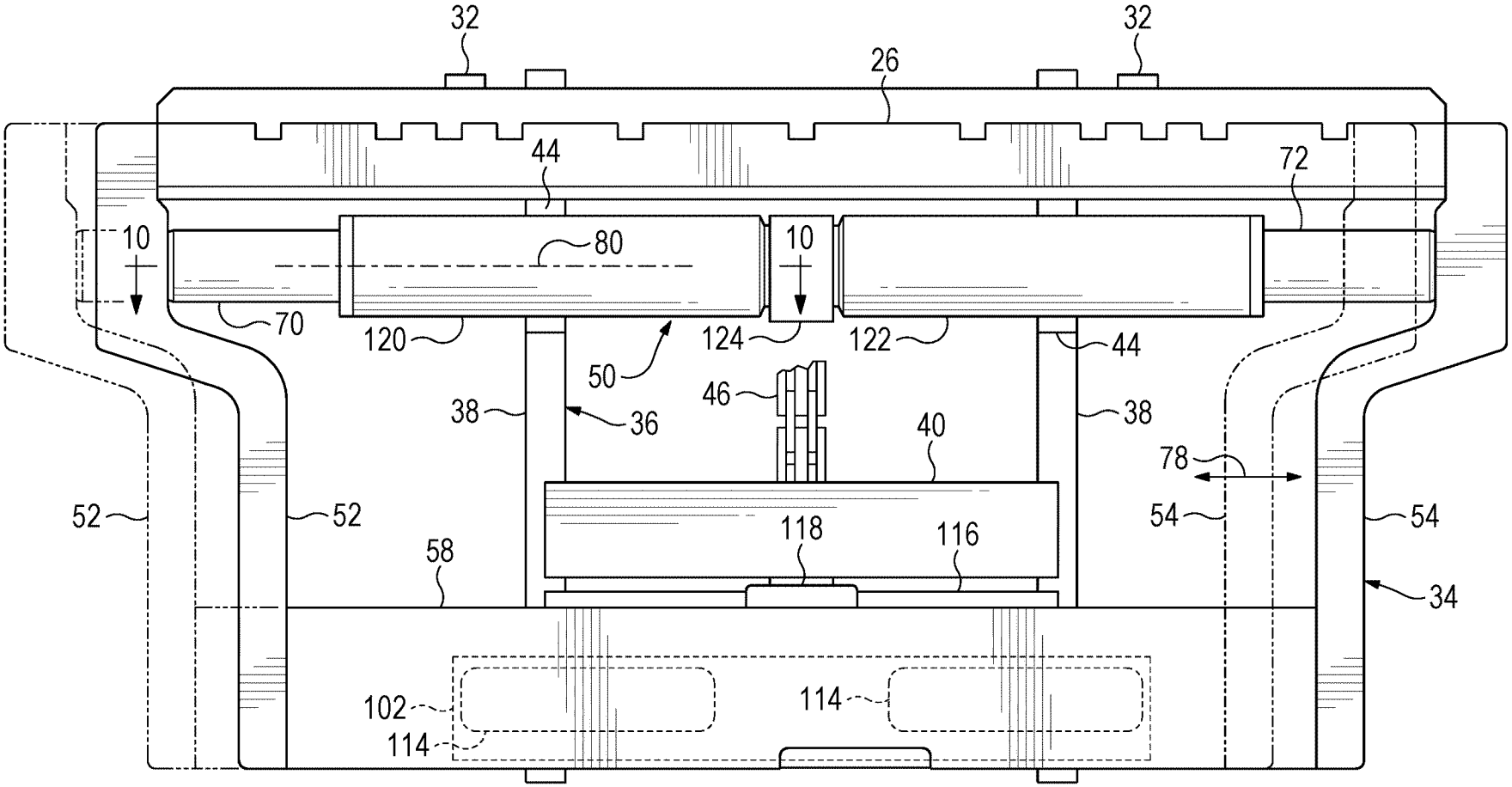
FIG. 6 is a front elevational view of the carriage shown in FIGS. 2-3
Figure 7:
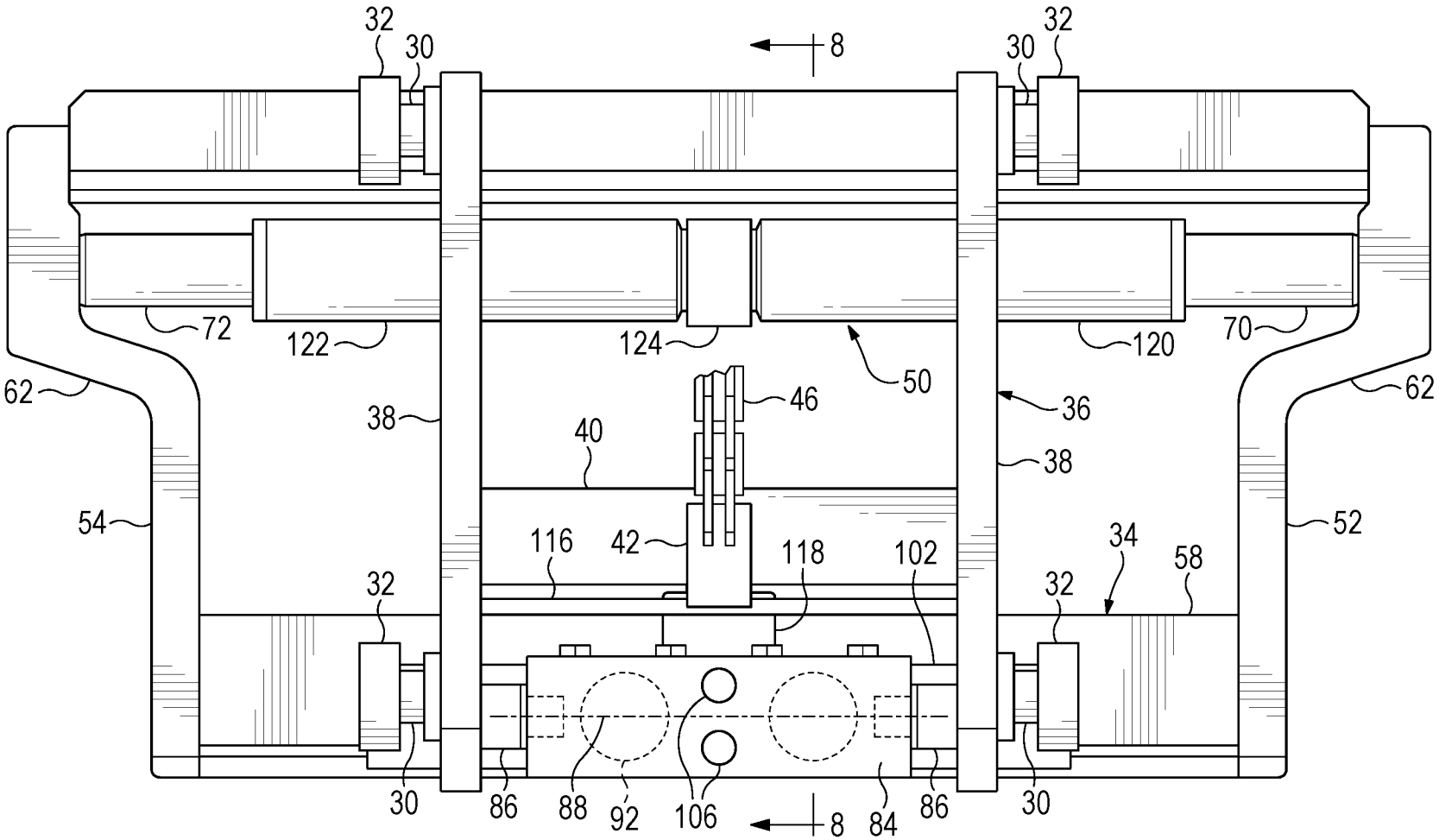
FIG. 7 is a rear elevational view of the carriage shown in FIGS. 2-3 and 6.

Extension of one of the piston rods 70 and 72 and retraction of the other within the side-shifter cylinder-and-piston assembly 50 effects lateral movement, or side-shifting, of the outer frame 34 with respect to the inner frame 36, as indicated by the arrow 78, and as shown by the broken-line depiction of the outer frame 34 in FIG. 6.

The carriage 24 also provides for an attachment such as the forklift forks 28 to tilt with respect to the mast 22 about a central axis 80 of the side-shifter cylinder-and-piston assembly 50, with the piston rods 70 and 72 rotating accordingly in the cylinders 120 and 122 of the side-shifter cylinder-and-piston assembly 50 through an angle about the central axis 80. In order to effect tilting, a cylinder block 84 is carried between the side members 38 of the inner frame 36. A pair of supports 86 are mounted on the side members 38 and define a transverse axis 88 about which the cylinder block 84 is able to pivot to remain oriented directly toward the inner face 90 of the bottom attachment mounting member 58.

The cylinder block 84 defines a pair of cylinders 92 in which respective pistons 94 are disposed and can move toward the outer frame 34. A piston rod 96 extends from each piston 94 through a respective cylinder head 98 including an appropriate piston rod seal. Fittings 100 are provided on the cylinder block 84 to admit hydraulic fluid pressure to move the pistons 94 in either direction in the respective cylinder 92. A tilt pusher bar 102 extends along the outer side of the cylinder block 84, the side facing toward the inner face 90 of the bottom attachment mounting member 58. A pair of guide pins 104 extend from the pusher bar 102 into corresponding bores 106 in the cylinder block, to keep the pusher bar 102 aligned parallel with the cylinder block as the pusher bar is moved by the tilt piston rods 96. Each piston rod 96 extends into a respective bore 108 provided as a receptacle in the pusher bar 102, and a suitable pin 110 fits through aligned bores 112 in the pusher bar 102 and through the piston rods 96, locking the piston rods 96 into the pusher bar 102, so that movement of the pistons 94 in their cylinders 92 moves the pusher bar 102 toward or away from the cylinder block 84.

Figure 8:
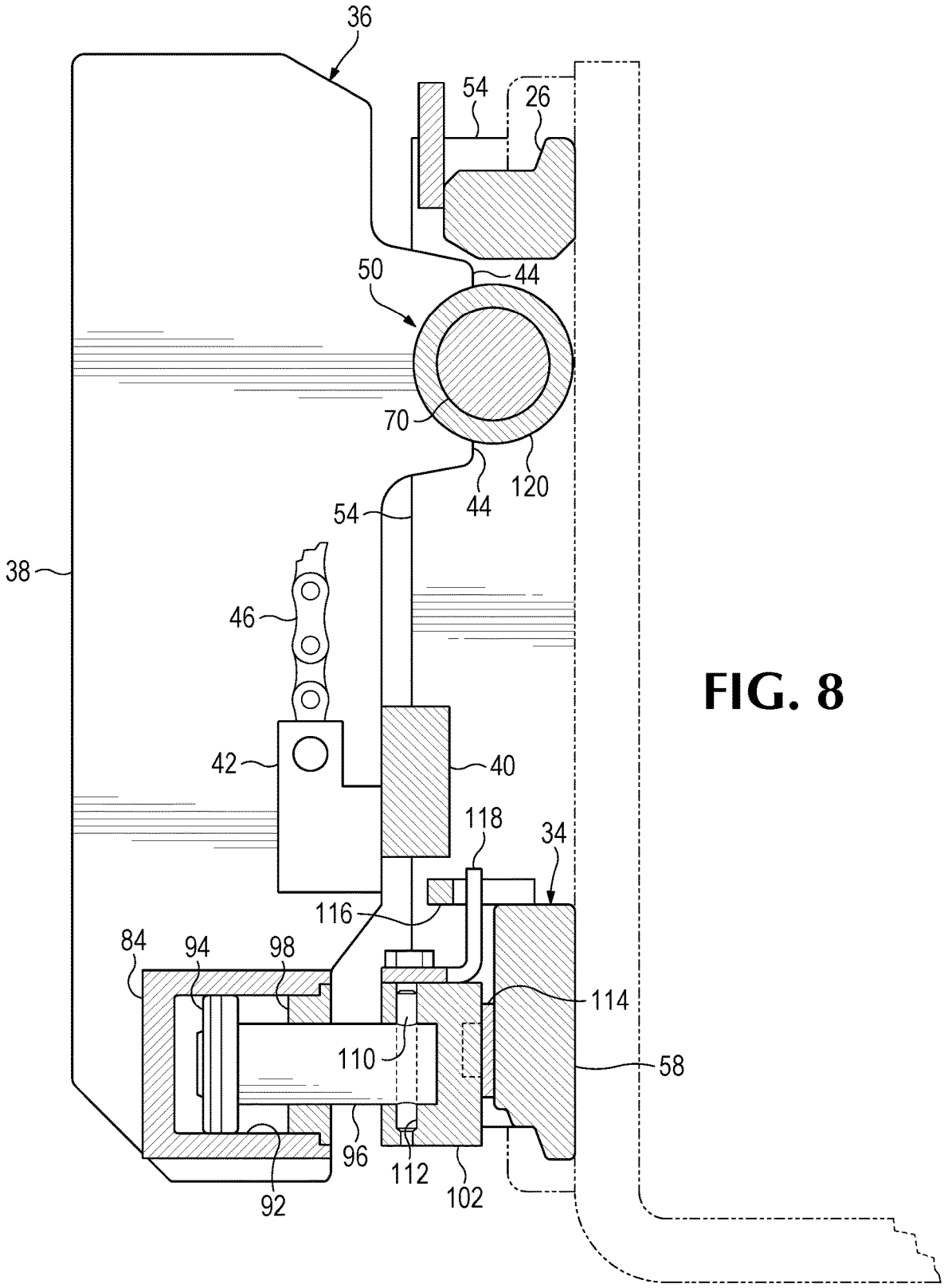
FIG. 8 is a sectional view, taken on the line 8-8 in FIG. 7.
Figure 9:
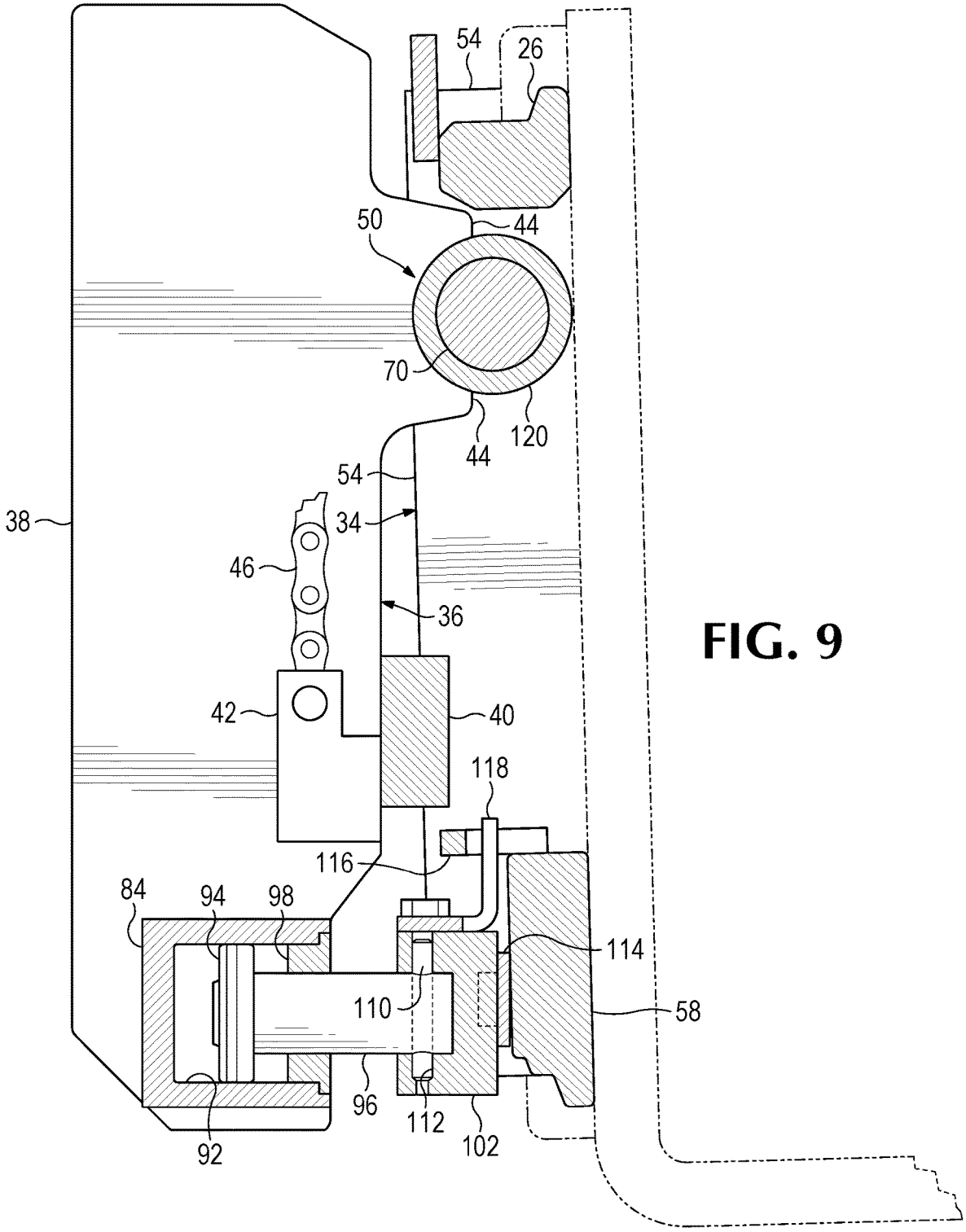
FIG. 9 is a sectional view, similar to FIG. 8, showing the outer frame of the carriage in a tilted orientation.

A pair of contact pads 114 of low-friction material, for example, a durable polymer such as nylon, are mounted on an outer face of the pusher bar 102 in position to rest against the inner face 90 of the transversely extending bottom attachment mounting bar 58 as shown best in FIGS. 8 and 9. As the side-shifter piston rods 70 and 72 move in either lateral direction, the inner face 90 of the bottom attachment mounting member 58 slides along the contact pads 114, which reduce or eliminate the need for lubrication of the inner face 90 of the bottom attachment mounting member 58 to accommodate lateral, side-shifting movement of the outer frame 34.

Referring to FIG. 8, with the outer frame 34 in a neutral orientation, tilted neither upward nor downward, the contact pads 114 rest against the inner face 90 of the bottom attachment mounting member 58. A tilt-limiting loop 116 is attached to the top of the bottom attachment mounting bar 58 and a tilt control member 118, fastened to an upper face of the pusher bar 102 is engaged in the tilt-limiting loop 116, to avoid inadvertent upward tilting of the outer frame 34, and to enable rearward, or inward, movement of the tilt pistons 94 to pull the bottom attachment mounting bar 58 inward to tilt the outer frame 34 downward with respect to the inner frame 36.

As shown in FIG. 9, outward movement of the pistons 94 in the tilt cylinders 92 moves the pusher bar 102 forward, or outward, against the inner face 90 of the bottom attachment mounting member 58, tilting the outer frame 34 upward, or counterclockwise as shown, with respect to the inner frame 36. The tilting movement, as shown in FIG. 9, is centered about the central axis 80 of the side-shifter cylinder-and-piston assembly 50. The amount of tilt available is limited by the range of motion of the pistons 94 in the cylinders 92 and the radius by which the pistons are spaced apart from the central axis 80.

As the outer frame 34 is tilted about the side-shifter cylinder central axis 80 the pistons 70 and 72 rotate within the bore of the side-shifter cylinder assembly 50.

Figure 10:
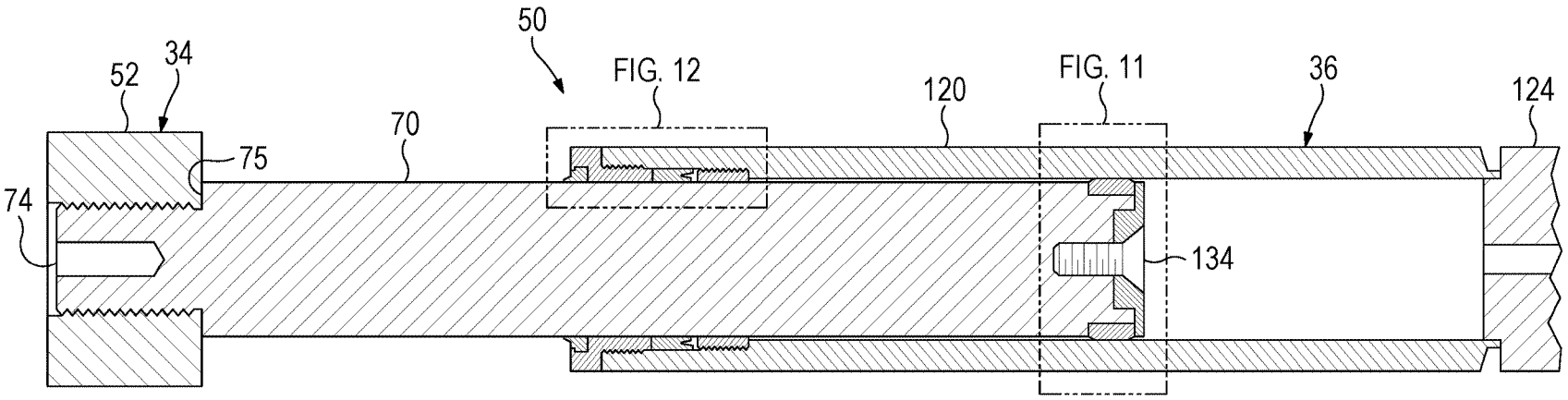
FIG. 10 is a sectional view taken on line 10-10 of FIG. 6.
Figure 12:
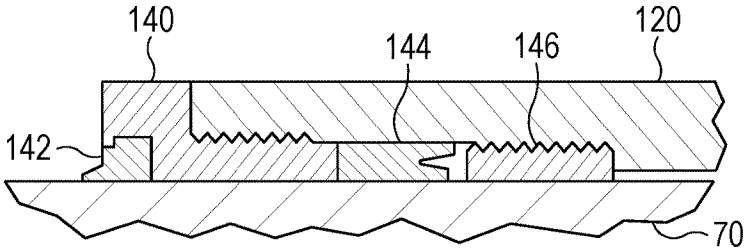
FIG. 12 is a detail view showing another portion of FIG. 10, at an enlarged scale.
Figure 11:
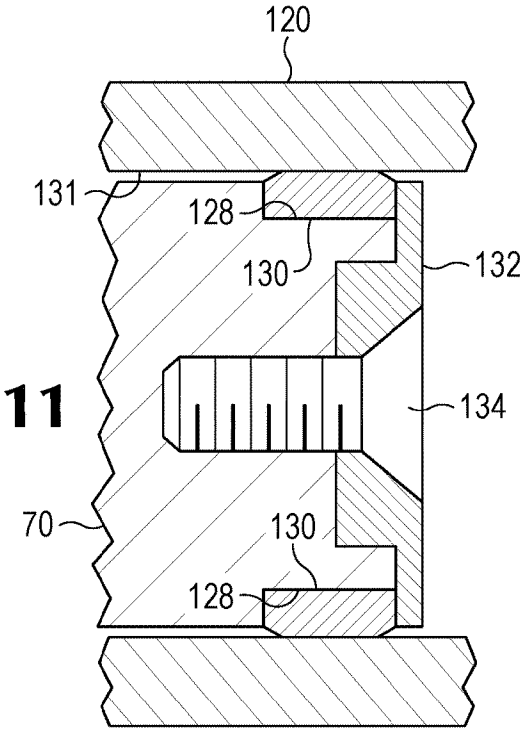
FIG. 11 is a detail view showing a portion of FIG. 10 at an enlarged scale.

As shown in FIGS. 10-12, the side-shifter cylinder-and-piston assembly 50 may preferably comprise a pair of displacement cylinders 120 and 122 arranged base-to-base. The adjacent inner ends of the cylinders 120 and 122 may be welded or otherwise securely attached to each other, or, preferably, to a fluid delivery manifold 124 located between the cylinders 120 and 122 and arranged to provide fluid under pressure selectively into one cylinder or the other so as to force the respective piston rod 70 or 72 outward to effect side-shifting movement of the outer frame 34.

At the inner end of the piston rod 70 or 72 a circumferential groove 128 holds a bearing 130 providing lateral support for the base, or inner end, of the piston rod 70. External oil passage grooves (not shown) in the bearing 130 allow passage of some hydraulic fluid between the bearing 130 and the cylinder wall surface 131 to lubricate the piston rod 70. The bearing 130 is retained by a disk-like retainer 132 kept in place in the base of the piston rod 70 by a suitable fastener such as a screw 134 threaded into the base of the piston rod, once the bearing 130 has been installed over the end of the piston rod, as shown in FIG. 11.

As shown in enlarged view in FIG. 12, a retainer gland 140 is held in the outer end of the cylinder 120 by mating threads. The retainer gland 140 retains an external piston rod wiper 142. Located internally and retained by the retainer gland 140 is a pressure seal 144 to retain hydraulic pressure to move the piston rod 70 within the cylinder 120. Located still further inward along the outer end of the cylinder 120 is an annular bearing 146, which may be retained in the cylinder 120 by mating threads, to provide radial support for the piston rod 70. The bearing 146 includes oil passage grooves to permit hydraulic fluid to pass the bearing 146 as lubrication for the piston rod 70. As may be seen in FIGS. 2-4 and 6-12 the piston rod 70 is supported in the side-shifter cylinder 120 by the bearings 130 and 146, and the carriage 24 has no bearings located externally of the cylinder 120 or 122 that support the piston rod 70 or 72 with respect to the inner frame 36. Thus, except for the forces of the tilt cylinders 92 required to tilt the outer frame 34 about the central axis 80 of the side-shifter cylinder-and-piston assembly 50, the outer frame 34 is supported by the presence of the side-shifter piston rods 70 and 72 in the cylinders 120 and 122.

The resulting arrangement, as has been described, allows the outer frame 34 to be tilted as required about the central axis 80 of the side-shifter cylinder assembly 50. This arrangement eliminates the need for routine lubrication of the side-shifter arrangement, while also minimizing the height of the carriage 24, making the carriage capable of being extended, together with any attachments, into a minimum height space between adjacent shelves.

The terms and expressions which have been employed in the foregoing specification are used therein as terms of description and not of limitation, and there is no intention in the use of such terms and expressions of excluding equivalents of the features shown and described or portions thereof, it being recognized that the scope of the invention is defined and limited only by the claims which follow.

What is claimed is:

1. A carriage for a lift truck, comprising:

(a) an inner frame adapted to be mounted on a lift truck mast for vertical movement along the mast;

(b) an outer frame including a pair of spaced-apart opposite side members;

(c) a side-shifter mechanism arranged to move the outer frame laterally with respect to the inner frame;

(d) a tilt mechanism arranged to tilt the outer frame with respect to the inner frame, about a laterally-extending tilt axis;

(e) wherein the side-shifter mechanism includes a transverse structural member of the inner frame that defines a side-shifter hydraulic cylinder having a central axis extending transversely with respect to the carriage and also includes a side-shifter piston rod fitted in the side-shifter hydraulic cylinder and movable transversely with respect to the carriage in the side-shifter hydraulic cylinder; the side-shifter piston rod having an outer end that is securely and rigidly interconnected with one of the side members of the outer frame, whereby the outer frame can be moved laterally with respect to the inner frame by movement of the side-shifter piston rod within the side-shifter hydraulic cylinder;

(f) wherein the side-shifter hydraulic cylinder includes a bearing located within the side-shifter hydraulic cylinder, the bearing thus being located functionally between the side-shifter hydraulic cylinder and the piston rod and providing radial support for the piston rod, and wherein the outer frame is attached to the inner frame and supported with respect to the inner frame by the side-shifter piston rod being located within the side-shifter hydraulic cylinder and supported by the bearing; and (g) wherein the central axis of the side-shifter hydraulic cylinder is the tilt axis.

2. The carriage for a lift truck of claim 1 wherein the side-shifter hydraulic cylinder is located between a transversely-extending upper attachment mounting member of the outer frame and a transversely-extending bottom attachment mounting member of the outer frame.

3. The lift truck carriage of claim 1 wherein the transverse structural member that defines a side-shifter hydraulic cylinder defines a pair of coaxially arranged side-shifter hydraulic cylinders and wherein there is a respective side-shifter piston rod disposed in each of the side-shifter hydraulic cylinders and fixedly interconnected with a respective one of the pair of opposite side members of the outer frame.

4. The lift truck carriage of claim 3 including a hydraulic fluid manifold communicating with the side-shifter hydraulic cylinders, the side-shifter hydraulic cylinders being located on opposite sides of the hydraulic fluid manifold and the hydraulic fluid manifold being located centrally between respective opposite side members of the inner frame, and the side-shifter hydraulic cylinders and the manifold being interconnected with the side members as an integral rigid structural member of the inner frame.

5. The lift truck carriage of claim 4 wherein the side-shifter piston rods are movable simultaneously within the respective side-shifter hydraulic cylinders, with one side-shifter piston rod moving toward the hydraulic fluid manifold and the other side-shifter piston rod moving away from the hydraulic fluid manifold, as the side-shifter mechanism moves the outer frame laterally with respect to the inner frame.

6. The lift truck carriage of claim 3 wherein the side-shifter piston rods are movable simultaneously within the respective side-shifter hydraulic cylinders, in the same lateral direction with respect to the rear frame.

7. The lift truck carriage of claim 1 including a carriage tilt cylinder-and-piston assembly mounted on the inner frame and including a piston rod movable with respect to the inner frame and arranged to push a member of the outer frame and thereby to cause the outer frame to tilt with respect to the inner frame, about the central axis of the side-shifter hydraulic cylinder.

8. The lift truck carriage of claim 1 wherein tilting movement of the outer frame with respect to the inner frame results in rotation of the side-shifter piston rod within the side-shifter hydraulic cylinder.

9. The lift truck carriage of claim 1 wherein the carriage is free from load-supporting bearings functionally located between the outer frame and an exterior of the side-shifter hydraulic cylinder.

10. The lift truck carriage of claim 1 wherein the tilt axis operably extends beneath an upper attachment mounting bar supported by the outer frame separately from said side-shifter piston rod.

11. The lift truck carriage of claim 1 wherein the inner frame is free from bearings arranged to support the side-shifter piston rod and located externally of the side-shifter hydraulic cylinder.

12. The lift truck carriage of claim 1 wherein the inner frame is free from bearings located externally of the side-shifter hydraulic cylinder and arranged to act in support of the outer frame other than to tilt the outer frame with respect to the inner frame.

* * * * *